US009181839B2

(12) United States Patent
Onodera et al.

(10) Patent No.: US 9,181,839 B2
(45) Date of Patent: Nov. 10, 2015

(54) EXHAUST PIPE

(75) Inventors: Takao Onodera, Fujisawa (JP); Yuuta Kageyama, Fujisawa (JP); Isao Ohara, Fujisawa (JP)

(73) Assignees: ISUZU MOTORS LIMITED, Tokyo (JP); HINO MOTORS LTD., Tokyo (JP)

( * ) Notice: Subject to any disclaimer, the term of this patent is extended or adjusted under 35 U.S.C. 154(b) by 428 days.

(21) Appl. No.: 13/698,187

(22) PCT Filed: May 16, 2011

(86) PCT No.: PCT/JP2011/061195

§ 371 (c)(1),
(2), (4) Date: Nov. 15, 2012

(87) PCT Pub. No.: WO2011/145560

PCT Pub. Date: Nov. 24, 2011

(65) Prior Publication Data

US 2013/0058838 A1 Mar. 7, 2013

(30) Foreign Application Priority Data

May 17, 2010 (JP) ..... 2010-113740

(51) Int. Cl.
*B01D 50/00* (2006.01)
*F01N 3/28* (2006.01)
*F01N 3/20* (2006.01)

(52) U.S. Cl.
CPC ..... *F01N 3/2853* (2013.01); *F01N 3/2867* (2013.01); *F01N 3/2066* (2013.01); *F01N 2570/18* (2013.01); *F01N 2610/02* (2013.01)

(58) Field of Classification Search
CPC .. F01N 3/2853; F01N 3/2066; F01N 2570/18
USPC ..... 422/177, 179, 180
See application file for complete search history.

(56) References Cited

U.S. PATENT DOCUMENTS

| | | | | |
|---|---|---|---|---|
| 4,335,077 | A * | 6/1982 | Santiago et al. | 422/179 |
| 6,245,301 | B1 | 6/2001 | Stroom et al. | |
| 2007/0148058 | A1 * | 6/2007 | Buckel et al. | 422/180 |
| 2009/0104091 | A1 | 4/2009 | Hoppenstedt et al. | |
| 2010/0007094 | A1 | 1/2010 | Goshima et al. | |

FOREIGN PATENT DOCUMENTS

JP 61098910 A * 5/1986

(Continued)

OTHER PUBLICATIONS

Written Opinion of the International Searching Authority mailed Jul. 12, 2011 in corresponding International Application No. PCT/JP2011/061195.

Patent Abstracts of Japan, Publication No. 07-080319, Published Mar. 28, 1995.

(Continued)

*Primary Examiner* — Tom P Duong
(74) *Attorney, Agent, or Firm* — Staas & Halsey LLP

(57) ABSTRACT

An exhaust gas purification catalyst, using a reducing agent, is provided on an inside of an exhaust pipe via a support member. A baffle portion for preventing the reducing agent from penetrating the exhaust gas purification catalyst is provided on a portion of an internal surface of the exhaust pipe, which is upstream of the exhaust gas purification catalyst.

7 Claims, 5 Drawing Sheets

(56) References Cited

FOREIGN PATENT DOCUMENTS

| | | |
|---|---|---|
| JP | 7-80319 | 3/1995 |
| JP | 2008-511795 | 4/2008 |
| JP | 2009-144636 | 7/2009 |
| WO | WO 2010/004637 | 1/2010 |

OTHER PUBLICATIONS

Patent Abstracts of Japan, Publication No. 2009-144636, Published Jul. 2, 2009.

International Search Report of PCT/JP2011/061195 mailed Jul. 12, 2011.

* cited by examiner

EXHAUST PIPE

CROSS-REFERENCE TO RELATED APPLICATIONS

This application claims the foreign priority benefit of Japanese Application No. 2010-113740 filed May 17, 2010, the contents of which are incorporated herein by reference, which serves as priority for PCT Application No. JP2011/061195 filed May 16, 2011.

TECHNICAL FIELD

The present invention relates to an exhaust pipe that includes an exhaust purification catalyst for reducing and purifying nitrogen compounds contained in exhaust gas discharged from an internal combustion engine, using a reducing agent to be supplied.

BACKGROUND ART

A selective reduction NOx catalyst (hereinafter, SCR) and an occlusion reduction NOx catalyst (hereinafter, LNT), for example, are well know as an exhaust purification catalyst that reduces and purifies nitrogen compounds (hereinafter, NOx) contained in exhaust gas discharged from an internal combustion engine.

In the SCR, the NOx in the exhaust gas can be reduced by promoting the reductive reaction of the NOx with ammonia (NH3) that is supplied as a reducing agent. In the LNT, the NOx in the exhaust gas is occluded when an air-fuel ratio of the exhaust gas is lean and occluded NOx is discharged when the air-fuel ratio is rich by the supplied fuel (HC) such that CO, HC, H2, and so on in the exhaust gas reduces the NOx. For the purpose of supplying the ammonia or the fuel to the exhaust purification catalyst as the reducing agent, a reducing agent injection valve is provided on the upstream side of the exhaust purification catalyst.

Patent document 1, for example, discloses an exhaust gas purification device in which a urea solution injector is provided on the upstream side of the SCR, and which supplies the ammonia to the SCR as the reducing agent by injecting the urea solution from the urea solution injector to the exhaust gas in an exhaust passage.

PRIOR ART DOCUMENTS

Patent Document 1: Japanese Patent Application Publication No. 2009-144636

In the above-mentioned system in which an urea solution injection means such as the urea solution injector is provided on the upstream side of the exhaust passage, and which supplies the urea solution from the urea injection means to the exhaust purification catalyst, part of the injected urea solution is not hydrolyzed in the exhaust gas and adheres on the inside wall surface of the exhaust pipe. The adhered urea solution is collected to the inside bottom of the exhaust pipe and flows to the downstream of the exhaust pipe, and as a result, the urea solution may reach to the upstream side adjacent to the exhaust purification catalyst. The exhaust purification catalyst, in general, is provided on the inside of the exhaust pipe via a support member such as heat resisting sponge, and therefore the urea solution that reaches the upstream side of the exhaust purification catalyst may penetrate the support member.

In a case where the temperature of the exhaust gas flowing in the exhaust pipe is increased under the state of the urea solution contained in the support member, the contained urea solution may cake and cause the support member expansion. When the support member expands, a stress is acting on the exhaust purification catalyst, and as a result, the exhaust purification catalyst may be damaged due to the stress.

SUMMARY OF THE INVENTION

The present invention has been designed in consideration of these problems, and an object thereof is to provide an exhaust pipe which prevents a reducing agent from penetrating into a support member for an exhaust purification catalyst, and effectively prevents the exhaust purification catalyst from being damaged due to the expansion of the support member.

To achieve the object described above, an exhaust pipe according to the present invention includes an exhaust gas purification catalyst for reducing and purifying nitrogenous compounds contained in exhaust gas discharged from an internal combustion engine by a reducing agent, that is provided on the inside of the exhaust pipe via a support member, wherein, a baffle portion for preventing the reducing agent from penetrating the exhaust gas purification catalyst is provided on the portion of the internal surface of the exhaust pipe, which is upstream side of the exhaust gas purification catalyst.

Further, the exhaust pipe may include an enlarged diameter portion formed in the longer internal diameter than the upstream side, and the exhaust gas purification catalyst may be provided on the internal surface of the enlarged diameter portion via the support member, and the exhaust gas purification catalyst may be provided on the internal surface adjacent to the upstream end of the enlarged diameter portion.

Further, the exhaust pipe may be formed in the cylindrical geometry, and the baffle portion may be formed in the circular-arc shape along the circumferential direction of the bottom of the internal surface of the exhaust pipe.

Further, the exhaust pipe may include a cushioning member, which is provided between the baffle portion and the exhaust gas purification catalyst.

Further, the baffle portion may be sloped toward the upstream side of the exhaust pipe.

Further, the baffle portion may be integrally formed with the exhaust pipe by projecting part of the exhaust pipe toward the inside.

Further, the exhaust pipe may include a selective reduction NOx catalyst as the exhaust gas purification catalyst, and using urea solution as the reducing agent.

With the exhaust pipe according to the present invention, penetration of the reducing agent into the support member for an exhaust purification catalyst can be prevented, and damage of the exhaust purification catalyst due to the expansion of the support member can be effectively prevented with a simple configuration.

DETAILED DESCRIPTION

Figure 1:
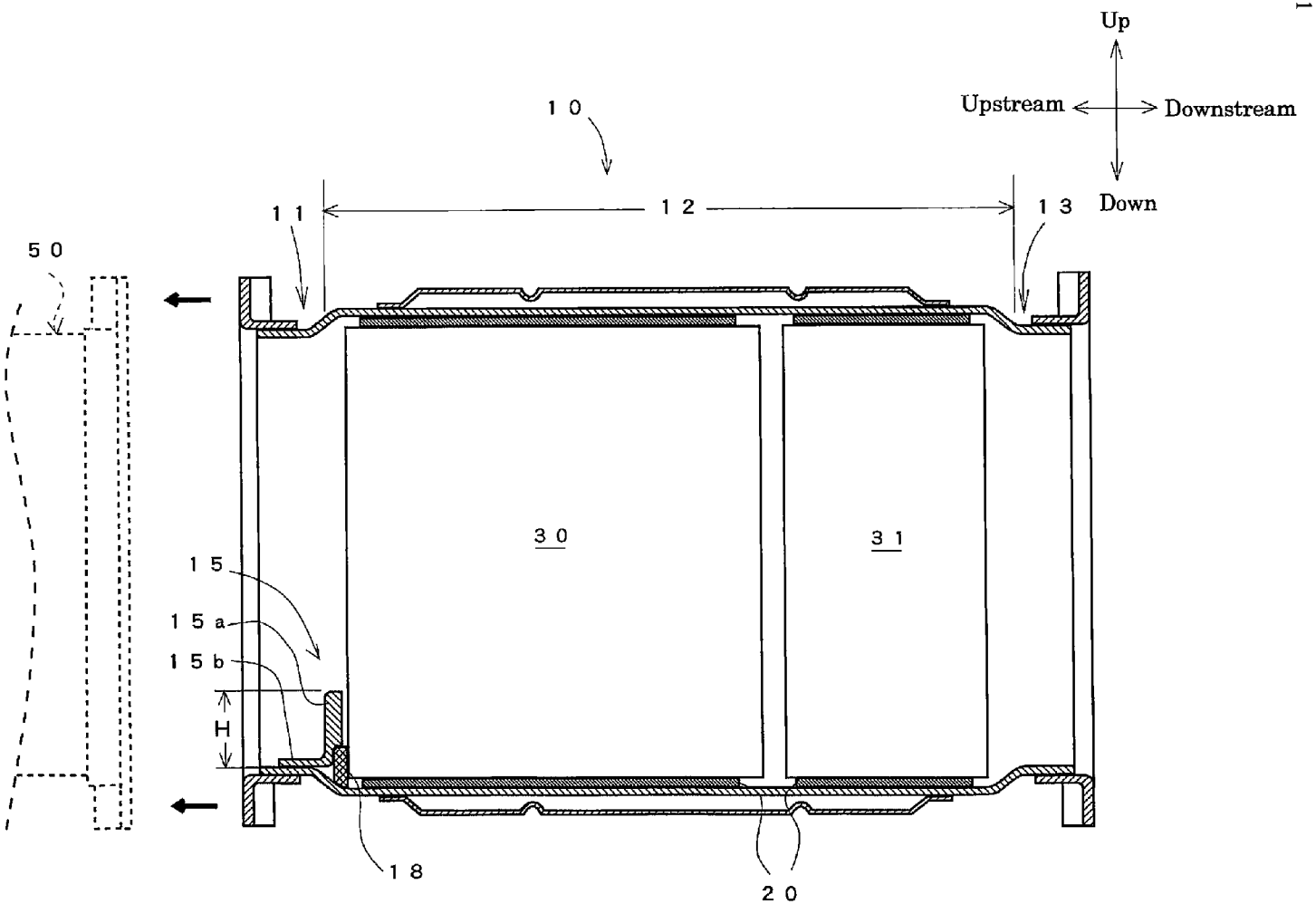
FIG. 1 is a section view showing a cross section structure of an exhaust pipe according to an embodiment of the present invention.

An exhaust pipe according to an embodiment of the present invention will be described below with reference to the FIGS. 1 and 2. Identical components have been allocated identical reference numerals and have identical names and functions. Accordingly, detailed description of these components will not be repeated.

Figure 2:
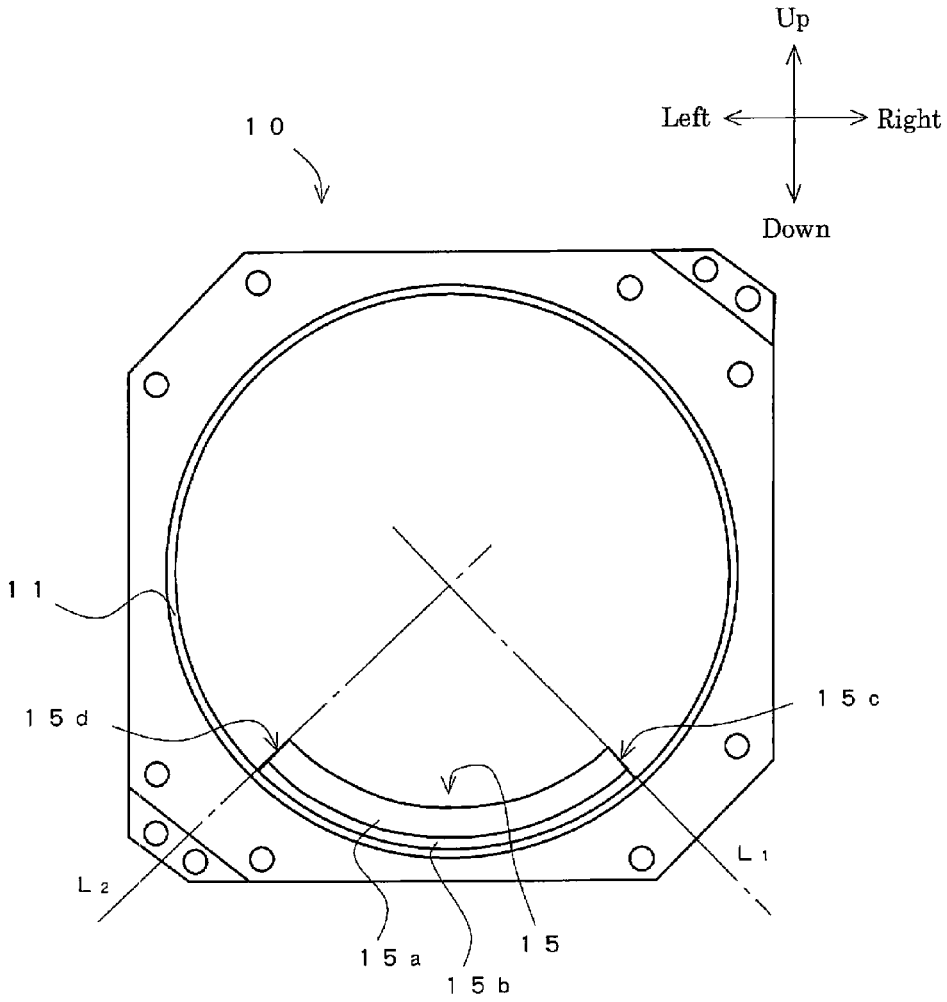
FIG. 2 is a front side view showing a structure of the exhaust pipe according to this embodiment of the present invention.

As shown in FIGS. 1 and 2, an exhaust pipe 10 according to this embodiment is in the form of a cylindrical geometry. The exhaust pipe 10, as shown in FIG. 1, is joined to a connecting pipe 50 that is connected to an exhaust system of an internal combustion engine (not shown), e.g., a diesel engine (hereinafter, engine). Further, the exhaust pipe 10 includes, in order from the upstream side, an upstream side pipe section 11 formed in the same internal diameter as the connecting pipe 50, a body section (enlarged diameter portion) 12 that is longer than the upstream side pipe section 11 and a downstream side pipe section 13 formed in the same internal diameter as the upstream side pipe section 11.

Further, as shown in FIG. 1, the exhaust pipe 10 includes, in order from the upstream side, an SCR 30 for reducing and purifying nitrogen compounds (hereinafter, NOx) contained in exhaust gas and an oxidation catalyst (hereinafter, DOC) 31.

The SCR 30 promotes the reductive reaction of the NOx contained in the exhaust gas when the exhaust gas discharged from the engine flows into therein. More specifically, when urea solution is injected from a urea solution injection means (not shown) provided on the upstream side, the exhaust gas hydrolyzes the injected urea solution, and as a result, ammonia is generated. The SCR 30 adsorbs the generated ammonia, and the NOx is reduced and purified by the adsorbed ammonia when the exhaust gas passing therethrough. Further, in a case where the excess ammonia slips past from the SCR 30, the DOC 31 provided on the downstream oxidizes and removes the slipped ammonia.

As shown in FIG. 1, both the SCR 30 and the DOC 31 are supported on the internal surface of the body section 12 via a mat member (support member) 20. In this case, for example a heat resisting sponge with heat resistance can be used as the mat member 20.

As shown in FIGS. 1 and 2, a baffle plate (baffle portion) 15 is formed in an L-shaped cross section in the shorter direction thereof, and includes a longitudinal baffle portion 15*a* with a predetermined height "H" and a lateral baffle portion 15*b*. Further, both the longitudinal baffle portion 15*a* and the lateral baffle portion 15*b* are formed with a circular-arc shape in the longitudinal direction thereof. Furthermore, the longitudinal baffle portion 15*a* is positioned in the downstream side and the lateral baffle portion 15*b* is welded on the lower part of an internal surface of the upstream side pipe section 11 so that the inflow of the urea solution from the upstream side pipe section 11 to the body section 12 can be prevented.

As shown in FIG. 2, when viewed from the front in axis direction, the baffle plate 15 is provided on the bottom of the internal surface of the upstream side pipe section 11 such that a normal line L1 of a right end 15*c* is perpendicular to a normal line L2 of a left end 15*c* at a center axis of the exhaust pipe 10.

Figure 3:
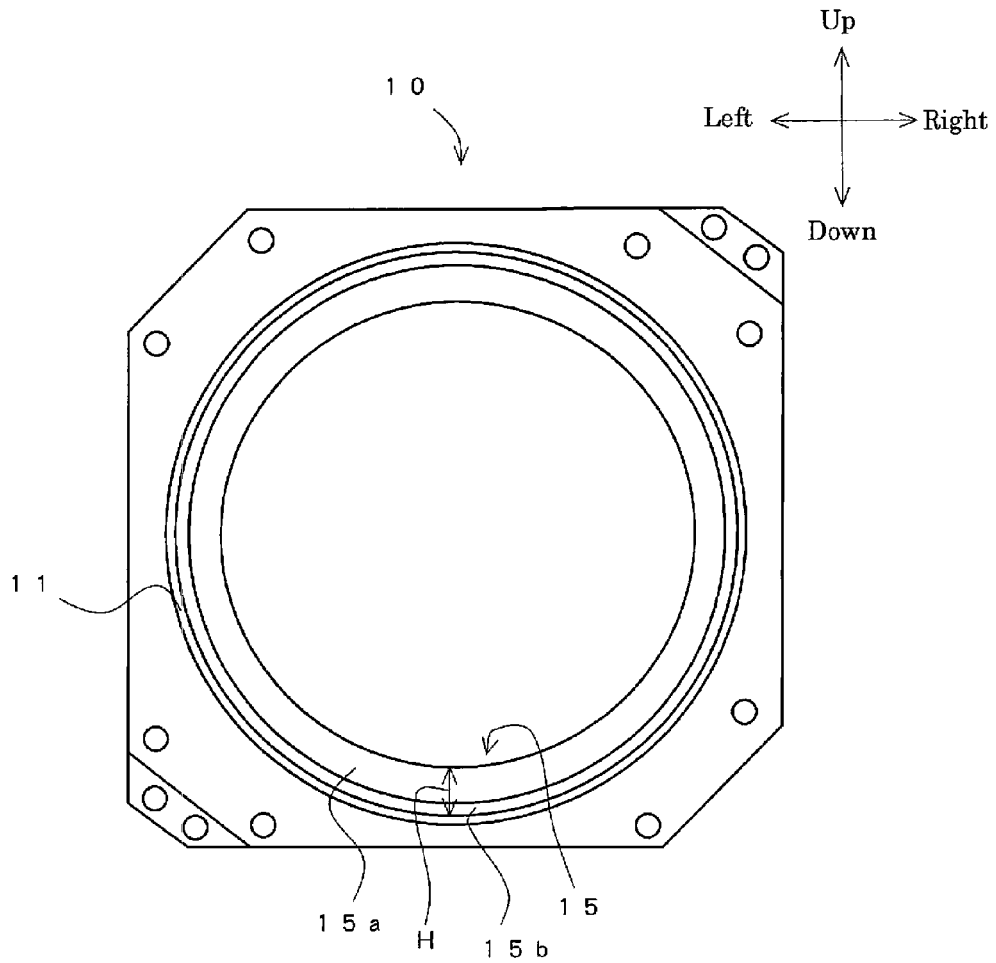
FIG. 3 is a front side view showing a structure of the exhaust pipe according to the other embodiment of the present invention.
Figure 4:
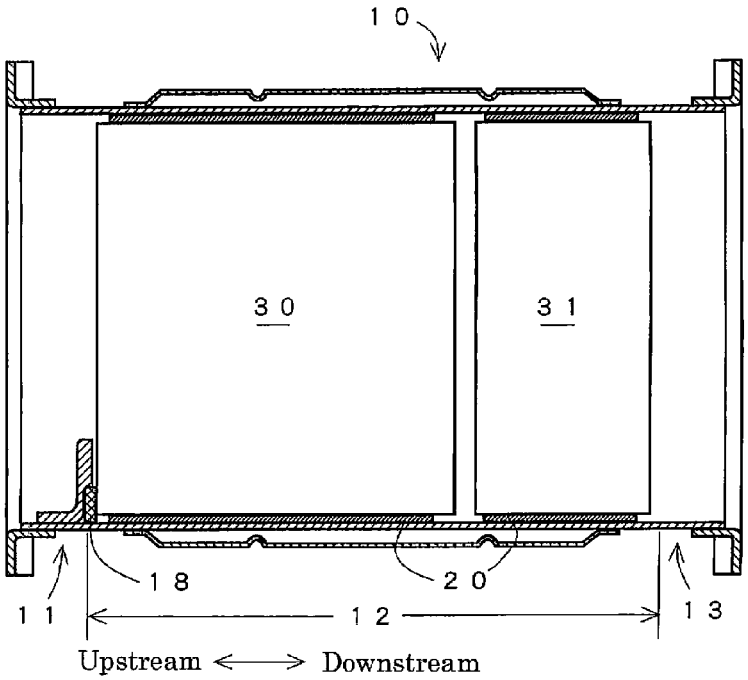
FIG. 4 is a section view showing a cross section structure of the exhaust pipe according to the other embodiment of the present invention.

As shown in FIG. 3, the baffle plate 15 can also be provided around the entire circumference of the internal surface of the upstream side pipe section 11. Further, the predetermined height "H" of the longitudinal baffle portion 15*a* can be adjusted according to the internal diameter of the exhaust pipe 10 or the capacity of the SCR 30 within the range in which the surface area of the longitudinal baffle portion 15*a* may not affect the exhaust gas flow. Furthermore, in this embodiment, the baffle plate 15, as shown in FIGS. 1 and 2, is positioned on the internal surface of the upstream side pipe section 11 adjacent to the upstream end of the body section 12, but this baffle plate 15 can be arranged at the upstream end of the internal surface of the upstream side pipe section 11.

As shown in FIG. 1, mesh pattern of a cushioning member 18 is provided between the baffle plate 15 and the SCR 30. The cushioning member 18 prevents the SCR 30 from moving to the upstream side in the axis direction, and prevents the front surface of the SCR 30 from contacting with a back surface of the longitudinal baffle portion 15*a*, and as the result, the SCR 30 can be protected from being damaged.

The cushioning member 18 can be provided around the entire circumference between the baffle plate 15 and the SCR 30, and can also be provided partially between these two.

By employing the configuration described above, following actions and effects can be obtained with the exhaust pipe according to this embodiment of the present invention.

For reducing and purifying the NOx in the exhaust gas, the urea solution is internally injected from the urea solution injection means (not shown) that is provided on the upstream part of the connecting pipe 50. A large portion of the injected urea solution is hydrolyzed in the exhaust gas and generated to the ammonia, but part of the injected urea solution is not hydrolyzed and therefore adheres on the internal surface of the connecting pipe 50. The adhered urea solution moves on the bottom of the connecting pipe 50 in the downstream direction and flows into the upstream side pipe section 11 of the exhaust pipe 10. When the urea solution reaches the upstream side pipe section 11, the baffle plate 15 that is provided on the internal surface of the upstream side pipe section 11 blocks the flowage of the urea solution.

Therefore, since the penetration of the urea solution into the body section 12 is prevented, the penetration of the urea solution into the mat member 20 that is supporting the SCR 30 and the DOC 31 in the body section 12 can also be prevented. As a result, damage to the SCR 30 or the DOC 31 due to the expansion of the mat member 20 can be suppressed efficiently. In particular, in a case where the baffle plate 15 is arranged around the entire circumference of the internal surface of the upstream side pipe section 11 (refer to FIG. 3), when the exhaust pipe 10 is dynamically vibrated in the vertical and horizontal direction, the penetration of the urea solution into the body section 12 can be certainly prevented.

Further, as time passes, a large portion of the urea solution blocked by the baffle plate 15 and held on the bottom of the internal surface of the upstream side pipe section 11 is hydrolyzed by the exhaust gas, and supplied to the SCR 30 to the ammonia is generated.

Therefore, the penetration of the urea solution into the mat member 20 can be certainly prevented, and the amount of unhydrolyzed urea solution can be reduced. As a result, both the efficiency of generating the ammonia and the efficiency of reducing and purifying the NOx can be certainly raised.

Further, in a case where the baffle plate 15 is provided not around the entire circumference of the internal surface of the upstream side pipe section 11 but partly provided on the bottom, the penetration of the urea solution into the mat member 20 can be certainly prevented without affecting the exhaust gas flowage in the exhaust pipe 10.

Furthermore, since a mesh pattern of the cushioning member 18 is arranged between the baffle plate 15 and the SCR 30, the movement of the SCR 30 to the upstream side in the axis direction can be prevented, and therefore the damage of the front surface of the SCR 30 caused by contacting with the back surface of the longitudinal baffle portion 15*a* can be prevented.

Note that the present invention is not limited to the embodiment described above and may be amended appropriately within a scope that does not depart from the spirit of the present invention.

For example, in the above embodiment, the internal diameter of the body section 12 is longer than the upstream side pipe section 11, but the internal diameter of the body section 12 can be formed with the same diameter as the upstream side pipe section 11 or the downstream side pipe section 13. In this case, the same actions and effects of the above embodiment can be obtained.

Figure 5:
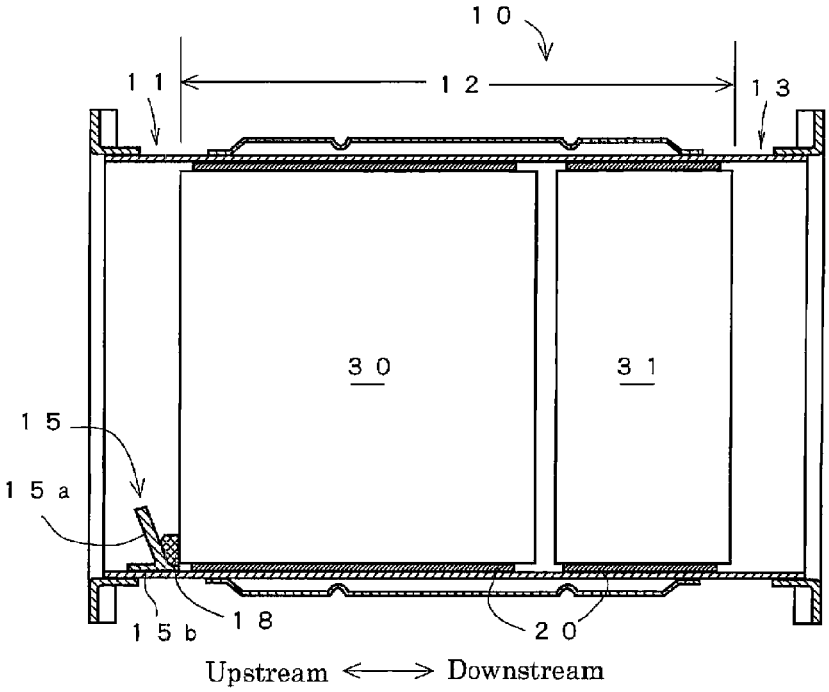
FIG. 5 is a section view showing a cross section structure of the exhaust pipe according to the other embodiment of the present invention.

Further, the longitudinal baffle portion 15*a* of the baffle plate 15 does not necessary have to be provided in the vertical direction, and can be sloped toward the upstream side of the exhaust pipe 10, as shown in FIG. 5.

Figure 6:
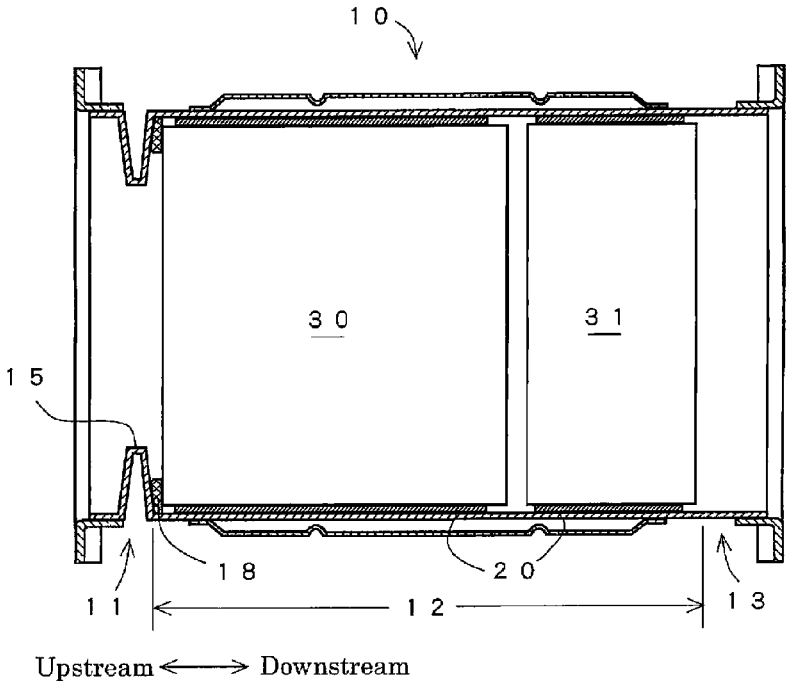
FIG. 6 is a section view showing a cross section structure of the exhaust pipe according to the other embodiment of the present invention.

Further, the baffle plate 15 is not necessarily formed of a plate material, but can be integrally formed with the exhaust pipe 10 by projecting part of the upstream side pipe section 11 toward the inside of the exhaust pipe 10. See FIG. 6.

Further, in the above embodiment, the exhaust pipe 10 is explained in which the SCR 30 is provided, but an occlusion reduction NOx catalyst (LNT catalyst) can be provided in place of the SCR 30. In this case, the penetration of an unburned fuel (HC) into the mat member 20 can be certainly blocked.

Further, the DOC 31 is not necessarily provided in the exhaust pipe 10, but can be eliminated.

Furthermore, in the above embodiments, the exhaust pipe 10 is in the form of a cylindrical pipe. However, the exhaust pipe 10 does not necessarily have to be formed in the cylindrical geometry, and a rectangular cross section pipe and the like can be also used.

The invention claimed is:

1. An exhaust pipe having an internal surface with an upper area and a lower area, an upstream end, and a downstream end, comprising:

an exhaust gas purification catalyst located within the exhaust pipe for reducing and purifying nitrogenous compounds contained in exhaust gas discharged from an internal combustion engine;

a support member for supporting the catalyst within the exhaust pipe;

wherein the exhaust pipe includes an enlarged diameter portion that is longer than the upstream end, and wherein the exhaust gas purification catalyst is supported relative to the internal surface within the enlarged diameter portion of the exhaust pipe via the support member; and a baffle located only at the lower area of the internal surface of the exhaust pipe on an upstream side of and spaced from the exhaust gas purification catalyst and adjacent to an upstream side of the enlarged diameter portion to prevent fluid from moving from a lower area of the upstream side of the exhaust pipe into the catalyst.

2. The exhaust pipe according to claim 1, wherein said exhaust pipe is cylindrical, wherein said baffle portion has an L-shaped cross section and includes a longitudinal baffle portion and a lateral baffle portion, wherein said longitudinal baffle portion and said lateral baffle portion are circular-arc shapes along a circumferential direction of a bottom of said internal surface of the exhaust pipe in a longitudinal direction thereof, wherein said longitudinal baffle portion is positioned at a downstream side with respect to said lateral baffle portion.

3. The exhaust pipe according to claim 2, wherein a cushioning member is provided between said baffle portion and said exhaust gas purification catalyst.

4. The exhaust pipe according to claim 2, wherein said exhaust gas purification catalyst is a selective reduction NOx catalyst, and said reducing agent is a urea solution.

5. The exhaust pipe according to claim 1, wherein a cushioning member is provided between said baffle portion and said exhaust gas purification catalyst.

6. The exhaust pipe according to claim 1, wherein said exhaust gas purification catalyst is a selective reduction NOx catalyst, and said reducing agent is a urea solution.

7. The exhaust pipe according to claim 1, wherein said baffle portion is sloped toward the upstream end of said exhaust pipe.

* * * * *